United States Patent [19]

Safar

[11] Patent Number: 4,567,723

[45] Date of Patent: Feb. 4, 1986

[54] METHOD OF SPINNING STAPLE FIBERS

[75] Inventor: Václav Safar, Liberec, Czechoslovakia

[73] Assignee: ELITEX koncern textilniho strojirenstvi, Liberec, Czechoslovakia

[21] Appl. No.: 597,464

[22] Filed: Apr. 6, 1984

[51] Int. Cl.[4] ..... D01H 1/135

[52] U.S. Cl. ..... 57/409; 57/404; 57/411; 57/413

[58] Field of Search ..... 57/400, 401, 404, 409, 57/411, 328, 408

[56] References Cited

U.S. PATENT DOCUMENTS 3,620,002 11/1971 Grishin ..... 57/413

4,322,942 4/1982 Fajt et al. ..... 57/400

*Primary Examiner*—John Petrakes

[57] ABSTRACT

Method of spinning staple fibers by imparting false twist to a continuous fiber bundle. The continuous fiber bundle is formed by a successive doubling of separated fibers, and is thereupon twisted by means of a false twisting element, the separated fibers being distributed along the twisted length of the fiber bundle, as well as along the untwisted section of the continuous fiber bundle.

14 Claims, 3 Drawing Figures

METHOD OF SPINNING STAPLE FIBERS

Figure 1:
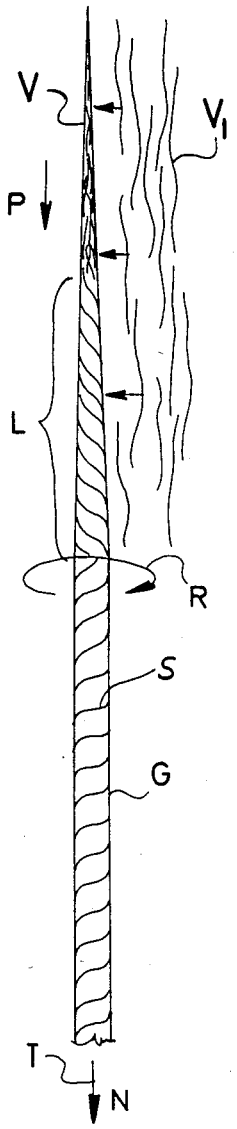

The present invention relates to a method of spinning staple fibers by imparting false twist to a continuous fiber band.

The spinning systems hitherto known can be divided into several groups from the viewpoint of preparing fibers and the twisting procedure. The preparation of fibers for twisting is usually performed by the successive refinement of a continuous fiber band, as e.g. a sliver or roving in a roller drafting mechanism, of which a continuous fiber band is formed at the delivery end.

Another method of preparing fibers for twisting is the loosening of a fiber band up to interrupting the mutual relations and contacts of the fibers. The separated fibers are either reconjugated into a continuous band, as e.g. in the collecting groove of a spinning rotor, or connected in separated condition to the formed yarn end.

The actual twisting of fibers can be performed in several known methods. The most known thereof is the twisting by rotation of the bobbin windings, from which the twist is transferred as far as the entering fiber band from the drafting delaying of the traveller behind the rotary motion of the bobbin winding.

The twisting of the fiber band formed by conjugating the separated fibers is included in the concept of open end spinning.

The best known representative of that kind of spinning is the method in which a spinning rotor is used in which, a fiber band is formed by so-called cyclic doubling on the collecting surface, said fiber band being penetrated by the twist arising upon rotation thereof along its total length. Thus, this fiber band is twistless except the mentioned section penetrated by the twist from the twisted yarn.

In a known method, the fiber band is straightened, and the fiber doubling takes place in a number of cycles, each of which equals one revolution of the spinning rotor.

A further representative of the open end spinning method is the assembling of separated fibers directly on the rotating yarn end, along its whole length. Of this method, various embodiments are known in which twist is imparted to the yarn end by friction of revolution surfaces, e.g. between two cylinders arranged close to each other, or between two surfaces of revolution, of which one is convex and the other is concave. In this method, the twist is transferred in the opposite direction, i.e. from the rotating yarn end, which is already twisted, along its whole length, in the direction towards yarn withdrawal.

Another spinning method is known, in which the separated fibers are assembled on the assembling means in parallel arrangement, and are fed in this condition in a direction transversal to the rotating yarn end, to which there is imparted twist in the section behind the point of attachment of the fibers. Therefore, this twist is transferred into the yarn end, to which there is imparted a rotary motion in that manner. The number of revolutions of the yarn end indicates substantially the number of twists in the yarn; however, the number of revolutions upon twist impartment is higher, as a part thereof is false, of a so-called temporary character.

A similar method is improved in such manner, that to the rotating yarn end there are fed parallely, in a transversal direction, two flows of fibers, which makes possible the assembling for the purpose of increasing the evenness of yarn, and also a blending of two components, in a differentiated manner, for both the inner and the outer yarn layers. Twist is inserted to the yarn end in this method again from the section comprising the total number of fibers in the cross section of the yarn.

Obviously, even further yarn manufacturing methods are known, e.g. electrostatic methods and air vortex methods, in which separated fibers are fed towards the rotating yarn end. Further methods of manufacturing yarn use the principle of false twist or temporary twist imparted to a continuous fiber band. Methods in which to the continuous band there is imparted a periodically alternating twist, or advantageously a periodically alternating twist being imparted to two continuous bands in such manner that the twist repeats are mutually offset along the yarn, are also known.

Methods of forming yarn from a continuous fiber band are also known in which to said band there is imparted by means of a false twisting element a twisting moment, the twist penetrating as far as the nip line of the delivery pair of drafting cylinders, and in which is achieved by a special procedure, that a part of the fibers from the continuous band is deflected, and consequently twisted in a manner other than the remaining part of this band. Upon passage through the twisting zone, the false twist is removed in said remaining part of the band, and the deflected fiber part forms winds around the untwisted part, thus reinforcing it. This method is disclosed and claimed in the application of Kroupa et al., Ser. No. 573,045, filed Jan. 23, 1984.

The improvements of this procedure aim at increasing that part of fibers in the fiber band which should be twisted by false twist in a manner different from the remaining part of that band.

For the purpose of obtaining this result, e.g. a method was developed, in which a further part of fibers in separated condition is fed separately to the false twisted band. The consequence of that method consists in obtaining yarn with parallely arranged fibers which are wrapped, upon removing the false twist, by the supplementary fed part of separated fibers.

A further modification using false twist is a method of forming bundle yarn, in which to a continuous staple fiber bundle there is imparted, upon leaving the nip line of the drafting mechanism, an opposite twist, one behind the other. The twisting element consists of two pneumatic nozzles, mounted in series and imparting a mutually opposite twist. The purpose of this method consists in releasing by the air flow in the first nozzle from the surface of the slightly twisted fiber band a part of free fiber ends, which rotate together with the rotating band, or which are wrapped by the air flow around said band in an opposite direction. The second nozzle, which performs a more intensive twist, secures a sufficiently intensive rotation and twisting of the band. Behind said second nozzle, the false twist is removed in the inner fiber layers, and the outer fiber ends, released by the preceding procedure, are consequently wrapped around the inner fiber layers, thus securing their reinforcement.

A further modification of the method using false twist is that in which the free fiber ends are formed and intentionally separated from the continuous flow already in front of the nip line of the delivery cylinder pair of the drafting mechanism. The aim of that modification is to achieve a different twisting of a part of the surface fibers from the continuous fiber flow coming out from the said mechanism and to secure at a part of the said fibers a releasing of their ends, which form winds with an opposite twist sense and thus secure a reinforcement of the yarn, upon passing through the twisting zone and removing the false twist on the continuous flow.

The application of the above-mentioned manufacturing methods of yarn has partial advantages and disadvantages, which demonstrate themselves by either technical or technological limitations in yarn manufacturing, or in specific properties of the yarn manufactured by each of these methods. The extent of advantages and disadvantages predetermines the extent of application of each method in practice.

So e.g. output limitations in ring spinning machines are known, and disadvantages following from the discontinuity of this spinning technology, in which it is necessary to stop the machine upon forming a bobbin winding, to replace the full cops by new tubes, and to restart the machine. Exceptionally, up to 20,000 rpm of the spindles are obtained, this being, however in comparison to other yarn manufacturing systems, a relatively low output limit. However, it is known that ring spun yarn is manufactured within a wide range of yarn counts, of almost all fibrous raw materials and with an almost universal applicability, because of an advantageous arrangement of fibers in the yarn and the properties of usage of this yarn consequently obtained.

The open end spinning procedures created the presumption of continuous yarn manufacturing by separating the twisting and winding of the yarn and substantially enhanced the output limit. So e.g. the spinning rotor has an upper output limit within the range of 100,000 rpm. However, many limiting factors are known, because of which the rotor speed has to be substantially reduced below this limit in practical operation. The yarn produced in the spinning rotor has a specific structure, and therefrom is also given its extent of application in textile products. The limits of economic advantage of this system are displayed in comparison with the ring spinning method. The rotor system displays economic advantages in coarse and middle yarn counts. Finer yarns are manufactured more advantageously, from the viewpoint of economy, in ring spinning machines.

In other open end methods, no economic advantage and yarn properties, properties necessary for universal applicability, or at least for a broader extent of application in world wide range were achieved.

The methods of manufacturing bundle yarn mentioned above, employing false twist pneumatic nozzles, make it possible to achieve high output, considerably higher in comparison with other known spinning methods.

It is a condition for the purpose of achieving stability of the spinning process, a satisfying yarn strength, and processability thereof in subsequent textile plants, to form on a continuous fiber bundle a sufficient number of sufficiently long free fiber ends and their strong embracement of the yarn core, or a regular entrapping of additionally fed separated fibers in the rotating fiber bundle. It can be presumed that he ore intensive and uniform the fibers of their parts are wound around the untwisted inner part of fibers, the broader the range of application which this yarn type can find in industrial practice. The methods hitherto known fulfill those presumptions only to a limited extent. They usually do not make it possible to influence with necessary reliability the arrangement of fibers in the yarn, and thus to modify their properties important for their processing and their advantageous application in textile products.

The aim of the present invention is to remove or at least substantially mitigate the disadvantages of the method of manufacturing bundle yarn and to make their characteristics more similar to ring spun yarn at high efficiency factors.

The method of spinning staple fibers by imparting false twist to a continuous fiber bundle according to the present invention consists in that the continuous fiber bundle is formed by the successive doubling of separated fibers and is thereupon twisted by a false twisting element, said separated fibers being distributed along the twisted fiber bundle length, as well as along the untwisted section of the continuous fiber bundle.

Further features, technological advantages and characteristic variations are specified in the following specification in the form of an exemplary embodiment of the subject matter of the present invention.

The advantages of the method of spinning fibers according to the present invention are observable in several aspects.

The procedure of forming a fiber bundle by doubling separated fibers result in the simultaneous improvement of its evenness, as known from other spinning technology elements.

The separated fibers fed to the rotating fiber bundle on the collecting surface are linked up under advantageous conditions, which secure a sufficient mutual contact of those fibers, which is a condition for the smoothness of the yarn surface and the forming of regularly distributed winds on its surface.

The extent of the twisting effect acting upon the fiber bundle can be adjustably modified for penetration of twist into this bundle, and thus influence the share of fibers in both the inner and the outer yarn layers. By this control, it is possible to influence adjustably the arrangement of the surface fibers, this being analogous to the extent of twist in ring spun yarn. The farther the twist penetrates on the collecting surface, the higher is the share of fibers subsequently fed to the rotating fiber bundle. This part of the fibers forms the surface structure of the yarn. By doubling the separated fibers on the collecting surface, a very advantageous and effective blending of the fibers in the yarn is achieved, this being advantageous particularly for blended yarns.

An extraordinary advantage of the method according to the present invention is the possibility of the mutual adaption of the circumferential velocity of the collecting surface and the speed of yarn withdrawal. This makes possible a modification of the fibrous structure, thus gaining useful properties according to the purpose of using the yarn. It is particularly advantageous that the procedure of spinning fibers on the collecting surface can be performed under adjustable tensioning, or possibly drafting of fibers, which is important for obtaining high yarn strength.

The performing of the method according to the present invention is also advantageous, a it makes possible a mere variation of certain parts of rotor spinning machines, thereupon obtaining a substantial increase of efficiency, together with a simultaneous decrease of power consumption and demands put on rotary elements of the spinning unit from the viewpoint of its stress. For the spinning according to the present invention, a delayed attachment of separated fibers to the rotating continuous bundle of fibers formed by doubling on the circumference of the doubling means, of which the circumferential speed is adapted to the withdrawing speed of the produced yarn, is characteristic.

The method according to the present invention is described in the following specification and the attached drawings; and is diagrammatically illustrated in FIGS. 1 and 2. An illustrative, preferred embodiment and apparatus for practicing the method of the invention is shown in FIG. 3 of the drawings.

IN THE DRAWINGS

Figure 2:
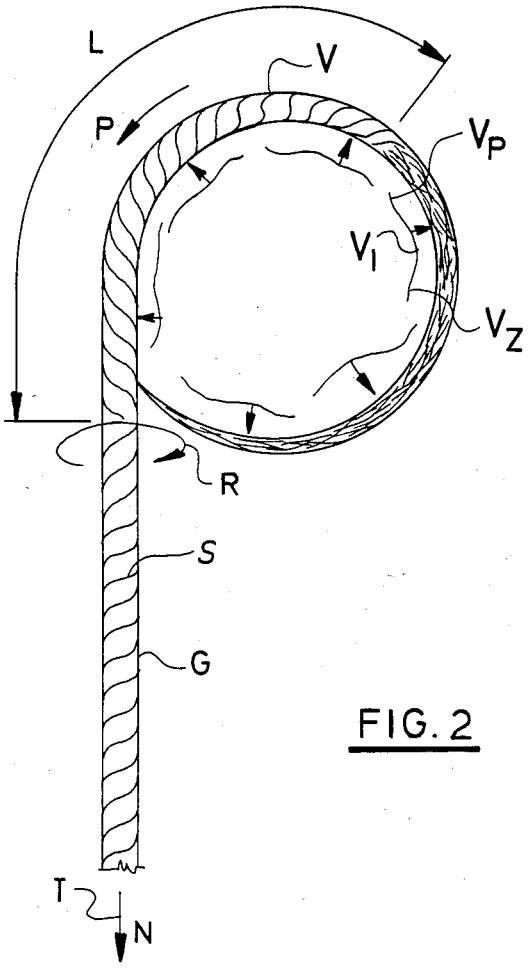
Figure 3:
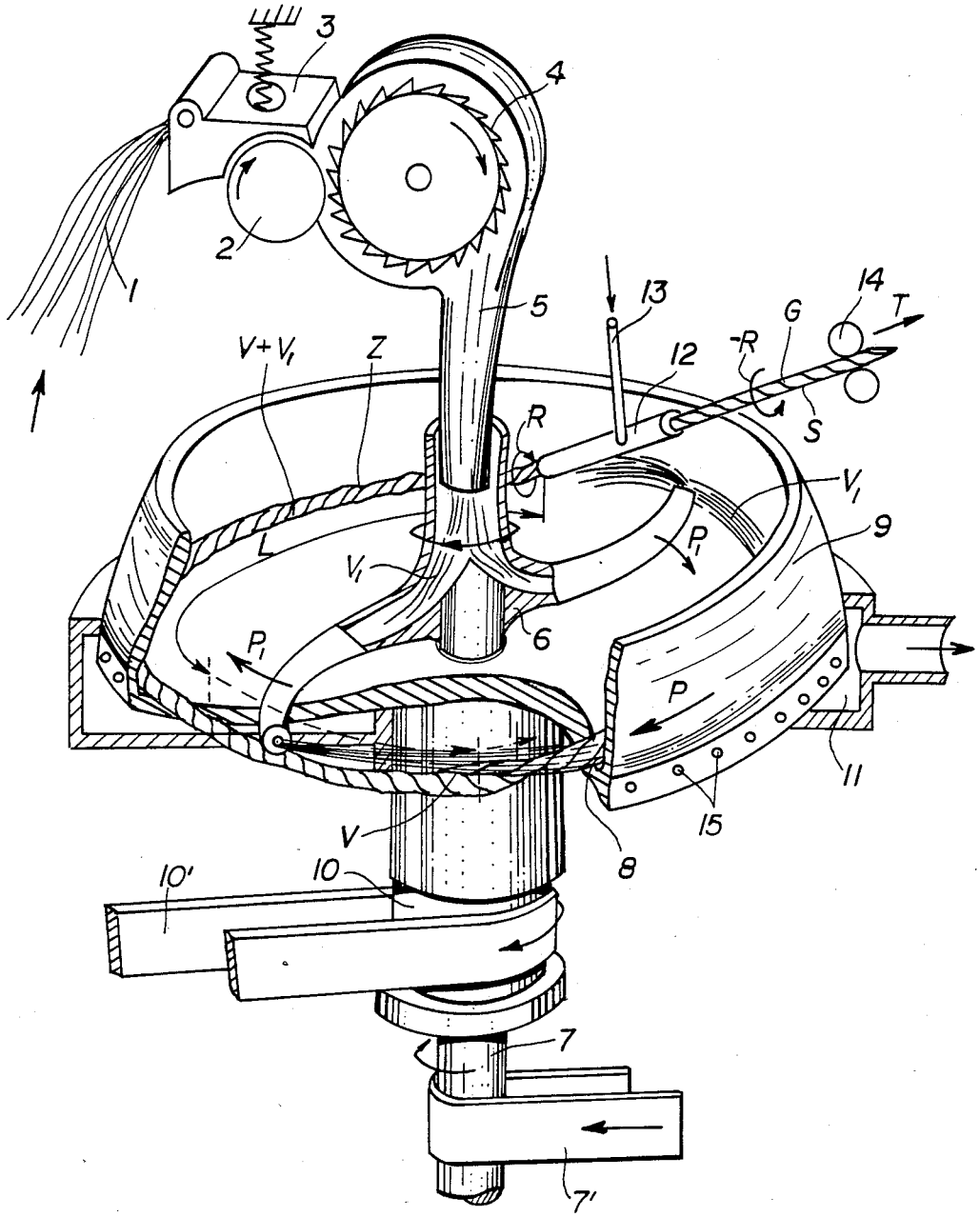

FIG. 1 schematically illustrates a first embodiment of method of spinning staple fibers according to the present invention, in which the separated fibers are fed towards the formed continuous fiber bundle about its whole length, said fiber bundle being twisted consequently into an adjustable length along the fiber bundle;

FIG. 2 schematically illustrates a second embodiment of spinning method according to the present invention, in which the continuous bundle is formed on a collecting surface of rotary shape, on which the fibers are laid about its whole circumference; and FIG. 3 is a schematic view in perspective, with certain parts in vertical section, of a preferred embodiment of apparatus for practicing the method of schematically illustrated in FIG. 2.

In each of FIGS. 1, 2 to 3, the fiber bundles V are represented in a diagrammatic view in the preparatory position before being twisted by a torque R. Torque R is opposite the torque −R.

Turning first to FIG. 1, such figure schematically shows the formation of a yarn G as it travels in a straight line in the direction of arrow T toward a yarn winding means N, not specifically shown. The distance L in FIG. 1 represents the section of the yarn which is penetrated by twist from torque R to which the yarn is subjected.

The spinning method according to the present invention schematically depicted in FIG. 1 is advantageously adapted for the application of a pneumatic vortex for twisting, the extent of imparting torque being easily controllable by the pressure of the fed air. This control is suitable for influencing the structure of the fibers in the yarn. As a higher torque R is imparted, the twist penetrates into the yarn through a further distance L. In this manner, a higher share of separated fibers $V_1$, is relatively fed additionally to the twisted part of the yarn bundle V, said share forming thereupon more intensive winds on the untwisted share of inner fibers on yarn G. An extreme case is the condition in which twist S penetrates as far as the tip of fiber bundle V, thus actually forming an almost rotating open yarn end, in which almost one-half of the fibers is preliminarily twisted in the fiber bundle V, and a further part of separated fibers $V_1$ is wound thereon subsequently. In FIG. 1, the direction P of feeding of the yarn bundle coinicides with the direction T of feeding of the finished yarn G.

The method according to the present invention can also be advantageously performed, as schematically illustrated in FIG. 2, in such manner that the separated fibers $V_1$ are fed to the collecting circumference of a rotary body and are doubled thereon into a fiber bundle V which comprises, in the direction from the element for imparting torque R, a gradually diminishing number of fibers, such number finally reaching a zero value. The element for imparting torque R can be mounted on a machine frame, and the yarn guided therefrom tangentially to the circumference of the rotary body, which in this case has a circumferential velocity corresponding to the speed of withdrawing of the yarn.

A further, unillustrated arrangement, is one in which the element for imparting torque R to the yarn performs a rotary motion. In this case, the body for doubling fibers to a fiber bundle V can be stationary in a general arrangement such as that schematically shown in FIG. 2. However, even arrangements can be made for performing the method according to the present invention, in which a rotary motion is performed by the element for imparting torque R, as well as the rotary body for doubling fibers to a fiber bundle V.

In the method according to the invention, as illustrated by both FIGS. 1 and 2, yarn is formed in such characteristic manner that the length of the twisted section L with a successively diminishing number of fibers has a certain number of twists at a given moment at each point along its length. In the direction upstream from the element for imparting torque R, the number of twists diminishes.

The subsequently fed separated fiber $V_1$ is simultaneously caught up on the twisted section L along its entire length, and participates therewith in the further rotary motion, as well as the motion in the withdrawing direction of the yarn. The yarn remains deposited substantially longitudinally, theoretically without twist, or is twisted with a small number of twists in the desired direction. Upon passing the twisting zone, the known procedure of releasing the false and temporary twists from on the temporary bundle is performed, thus leaving its substantially without twist.

During this procedure, those fibers, which were at the preceding moment without twist on the surface, are twisted. The said fibers form winds around the untwisted inner layer, which additionally reinforces the yarn. The method according to the present invention makes its possible suitably to influence the transition of separated fibers $V_1$ to the collecting circumference, as shown in FIG. 2.

In FIG. 2, fiber $V_1$ is shown with ends marked in relation to the element for imparting torque R thereto. $V_p$ denotes the front end of such fiber, and $V_z$ represents the rear end thereof. The importance of this method consists in that the fiber $V_1$, when contacting with its front end $V_p$ the rotating, false twisted section L, is wound in e.g. the direction to the right, when upon contacting with its rear end $V_z$, it is wound in the opposite direction, that is to the left upon maintaining the direction of rotation by torque R. In the first case, the twists on fiber $V_1$ are in the direction to the right, and such twists are subtracted upon passage through the twisting zone, while in the second case, that is, wherein the twisting direction is to the left, the twist on fiber $V_1$ are added upon the passage of the yarn through the twisting zone. In the second case, the winds of fibers $V_1$ on yarn G are more highly tensioned, and thus a yarn of higher strength is obtained.

By selecting the length of section L, and thus also the share of wrapping fibers from the total number of fibers, and the method of connecting fibers $V_1$ to the false twisted section L, it is possible to adapt the spinning method according to the present invention to the character of the fibrous raw material and the requirements of the required properties of the manufactured yarn.

In FIG. 3 there is schematically illustrated a preferred embodiment of apparatus for practicing the method schematically illustrated in FIG. 2. A sliver of staple fibers 1 is fed by delivery roller 2 between it and pressure member 3 to a combing roller 4. Separated fibers $V_1$ are forwarded through a supply channel 5 to a rotary distributor 6, distributor 6 being mounted upon a driving shaft 7 which is driven in the direction of the lower curved arrow by a driving belt 7' travelling in the direction indicated by the straight arrow.

Mounted coaxially of the shaft 7 and supported thereon is an upwardly open cup-shaped rotary body 9 having an inner circumferential fiber collecting groove 8, groove lying radially outwardly of and somewhat below the outer ends of the oppositely disposed arms of the rotary distributor 6. The rotary body 9 is shown as being driven in the same direction as the distributor 6 by a belt 10' which travels partially about a pulley 10 which is rigidly connected to the rotary body 9.

The lower outer edge portion of the rotary body 9 is provided with a plurality of radially directed holes 15 there through, air and impurities travelling outwardly from the interior of the rotary body 9 into an annular suction chamber 11 connected to a source (not shown) of reduced pressure. A twisting element 12 is disposed within the rotary body 9 to receive fibers from the collecting groove 8 in rotary body 9. Twisting element 12 is provided with a tangentially disposed supply 13 of pressure air whereby to subject the yarn passing therethrough to a false twist. The finished yarn G emmerging from the twisting element 12 and having a twist S is pulled outwardly by draw-off rollers 14 in the direction T.

In FIG. 3 as in FIGS. 1 and 2, the separated fibers emmerging from the combing roll 4 are designated $V_1$, and the bundle of separated fibers $V_1$ which are spread in the collecting groove 8 are designated V. $V+V_1$ indicates a bundle V of separated fibers $V_1$ already twisted by the torque R to the false twist Z. On the surface of this bundle there are stuck or wrapped further separated fibers $V_1$ from the rotary distributor 6. The separated fibers $V_1$ are stuck to the twisted bundle either longitudinally by simple mutual adhesion or are held by either their front end $V_p$ or by the rear end $V_z$ i.e. mutually differently. (See FIG. 2.)

These differently stuck separated fibers $V_1$, are now not so intensively twisted as the core of the bundle V of fibers; rather, they remain lying longitudinally on the twisted bundle V (they rotate together with the bundle V). The separated fibers form reinforcing winds with opposite twist upon the passing of the formed yarn G through the twisting element 12.

In FIG. 3 L represents the distance through which the false twist Z enters from the twisting element 12 into the bundle V of separated fibers $V_1$ which are spread in collecting annular groove 8 in rotary body 9. R indicates the direction torque imposed upon a bundle of fibers by the twisting element 12 as they enter such element, whereas $-R$ indicates the oppositely directed torque imposed upon the yarn G after it has left the twisting element 12 and approaches the draw-off 14.

P represents the circumferential velocity of the collecting groove or inner circumference of the rotary body 9. $P_1$ represents the circumferential velocity of the rotary distributor 6, or the velocity of spreading of the separated fibers $V_1$ in the collecting groove 8 of the rotary body 9. T is the draw-off velocity of the finished yarn G.

T, P, and $P_1$ have the following mutual relations as to velocities:

$$T=P$$

$$P \gtreqless P_1$$

In the case, that $P>P_1$ the whole apparatus can serve to efficient dilution of the fiber bundle V with high uniformity of the bundle taking into account the other parameters of the technological working of the fiber bundle to yarn. As is evident from the above discussion of FIG. 2, the arrangement of the device of FIG. 3 can also be made out in such manner that the rotary body 9 with the annular collecting groove 8 is stationary, the twisting element 12 rotating with respect to the body 8 with a velocity equal to the velocity T of the draw-off yarn G.

Although the invention is described and illustrated with reference to a plurality of embodiment thereof, it is to be expressly understood that it is in no way limited to the disclosure of such preferred embodiment but is capable of numerous modifications within the scope of the appended claims.

I claim:

1. A method of continuously spinning staple fibers by imparting false twist to a continuous fiber bundle formed by the doubling of staple fibers on a collecting circumference of a rotary body by the motion of a fiber bundle distributor along the collecting circumference of the rotary body, said method comprising continuously drawing-off from the collecting circumference the fiber bundle formed thereon and simultaneously false twisting the bundle in a first false twisting zone, continuously spreading and adhering to the drawn-off first false twisted fiber bundle separated staple fibers along an already twisted section of the fiber bundle as well as along a section of the fiber bundle being formed which has not as yet been twisted, after passage of the drawn-off fiber bundle through the first false twisting zone and after termination of the first false twisting continuously winding further separated fibers about the drawn-off fiber bundle in a manner different from the first false twist, whereby to form a reinforced fibrous layer of yarn.

2. A method of spinning fibers as claimed in claim 1, wherein the fiber bundle moves in the direction toward a twisting element at a speed corresponding to the speed of yarn withdrawal.

3. A method as claimed in claim 2, wherein the point of withdrawing the fiber bundle from the collecting circumference of the rotary body is located fixedly with respect to the frame of the twisting machine.

4. A method as claimed in claim 2, wherein the length of the twisted section of the fiber bundle is adjustable.

5. A method as claimed in claim 1, wherein the fiber bundle is acted upon by a torque produced by the rotary effect of a gaseous fluid.

6. A method as claimed in claim 1, wherein the fiber bundle is formed of separated fibers doubled on the collecting surface of the rotary body.

7. A method as claimed in claim 1, wherein the adhesion of separated fibers to the fiber bundle is influenced by the manner of the first mutual contact between them.

8. A method as claimed in claim 1, wherein the separated fibers contact the fiber bundle simultaneously along the whole length of the separated fibers.

9. A method as claimed in claim 1, wherein the separated fibers first contact the fiber bundle at the leading ends of the separated fibers.

10. A method as claimed in claim 1, wherein the separated fibers first contact the fiber bundle at trailing ends of the separated fibers.

11. A method as claimed in claim 1, wherein the length of the twisted section of the fiber bundle is adjusted by the value of the false twisting torque to which the fiber bundle is subjected.

12. A method as claimed in claim 1, wherein the value of the false twisting torque to which the fiber bundle is subjected is adjustably controllable by the rotary effect of a gaseous fluid.

13. A method as claimed in claim 12, wherein the rotary effect of the gaseous fluid is controllable by the pressure thereof.

14. A method as claimed in claim 12, wherein the rotary effect of the gaseous fluid is pressure air.

* * * * *